US009436149B2

(12) United States Patent
Tanaka

(10) Patent No.: US 9,436,149 B2
(45) Date of Patent: Sep. 6, 2016

(54) IMAGE FORMING APPARATUS

(71) Applicant: CANON KABUSHIKI KAISHA, Tokyo (JP)

(72) Inventor: Koichi Tanaka, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/271,328

(22) Filed: May 6, 2014

(65) Prior Publication Data

US 2014/0331801 A1 Nov. 13, 2014

(30) Foreign Application Priority Data

May 8, 2013 (JP) ..... 2013-098657

(51) Int. Cl.
*G03G 15/00* (2006.01)
*G03G 15/16* (2006.01)

(52) U.S. Cl.
CPC ..... *G03G 15/757* (2013.01); *G03G 15/1615* (2013.01); *G03G 2215/0129* (2013.01); *Y10T 74/19684* (2015.01)

(58) Field of Classification Search
CPC ..... G03G 15/757
USPC ..... 399/167
See application file for complete search history.

(56) References Cited

U.S. PATENT DOCUMENTS

| | | | | |
|---|---|---|---|---|
| 5,210,574 | A * | 5/1993 | Kita | 399/117 |
| 5,353,099 | A * | 10/1994 | Tsunoda | 399/167 |
| 5,950,052 | A * | 9/1999 | Nomura et al. | 399/167 |
| 6,626,139 | B1 * | 9/2003 | Horita et al. | 123/192.2 |
| 2005/0115350 | A1 * | 6/2005 | Ohashi et al. | 74/425 |
| 2005/0225625 | A1 * | 10/2005 | Sawai | 347/220 |
| 2007/0238571 | A1 * | 10/2007 | Sugitani | 475/227 |
| 2008/0178697 | A1 * | 7/2008 | Imagaki et al. | 74/388 PS |
| 2011/0017003 | A1 * | 1/2011 | Taniguchi | 74/412 R |

FOREIGN PATENT DOCUMENTS

JP 1988-113477 A 5/1988

* cited by examiner

*Primary Examiner* — Rodney Fuller
(74) *Attorney, Agent, or Firm* — Canon U.S.A. Inc., IP Division

(57) ABSTRACT

An image forming apparatus includes a speed reduction device including a first gear and a second gear meshing each other. A ratio between teeth of the first gear and teeth of the second gear is an integer. One of the first gear and the second gear has a large diameter, and the other has a small diameter. The entire gear or the teeth of the gear having the large diameter is formed of a material having a higher modulus of longitudinal elasticity than a modulus of longitudinal elasticity of the gear having the small diameter.

2 Claims, 10 Drawing Sheets

IMAGE FORMING APPARATUS

BACKGROUND OF THE INVENTION

1. Field of the Invention

The present invention relates to an image forming apparatus using an image carrier such as a photosensitive drum and an intermediate transfer belt. In particular, the present invention relates to an image forming apparatus that uses a gear-speed reduction device configured to drive an image carrier.

2. Description of the Related Art

Conventionally, an image forming apparatus uses a gear-speed reduction device, to drive rotation of a photosensitive drum or an intermediate transfer belt.

For example, in an image forming apparatus using an intermediate transfer belt, power of a drive source such as a motor is transmitted to a driving roller moving the intermediate transfer belt, while a speed is reduced by a plurality of gears.

In a gear-speed reduction device, it is usual to avoid using an integer ratio, as a ratio between the numbers of teeth of a plurality of gears. This is because when the integer ratio is used, a certain tooth of a gear unevenly wears out, by repeatedly coming in contact with the same tooth of a counterpart gear to mesh with.

The above-mentioned wearing out will be described using an example of a speed reduction device having a speed reduction ratio of 4:1 (an integer ratio). This speed reduction device includes a gear A having 80 teeth and a gear B having 20 teeth, as illustrating in FIG. 1. The gear B is driven by power, and the gear A follows by meshing with the gear B. When a speed reduction ratio, namely, a ratio between the numbers of teeth of the gears, is an integer, a tooth B-1 regularly comes in contact with a tooth A-1. Repeated contact by the same tooth causes uneven wear, so-called imprinting, in which the shape of the tooth B-1 is transferred to the tooth A-1 as illustrated in FIG. 2.

Here, an adverse effect due to the occurrence of the imprinting in an image forming apparatus will be described.

FIG. 3 illustrates a velocity fluctuation when the gear A rotates. A velocity fluctuation component of one turn and one tooth occurs corresponding to the precision of the gear A. Here, the number of teeth of the gear A is 80, which therefore creates a waveform in which sine waves of 80 teeth are superimposed on a sine wave corresponding to a velocity fluctuation for one turn of the gear A. Similarly, FIG. 4 illustrates a velocity fluctuation when the gear B rotates. The number of teeth of the gear B is 20, which therefore creates a waveform in which sine waves of 20 teeth are superimposed on a sine wave corresponding to a velocity fluctuation for one turn of the gear B, and this waveform occurs successively. The speed reduction ratio is 4:1. Therefore, the gear B makes four turns for a single turn of the gear A. When these two gears rotate while meshing with each other, the velocity fluctuations form a composite wave, becoming a velocity fluctuation illustrated in FIG. 5.

When the speed reduction ratio is an integer ratio, the imprinting occurs due to the contact between the same teeth of the gears meshing with each other, as described above. When the shape of one tooth of the gear B is imprinted on the gear A, a velocity fluctuation component of the one tooth of the gear B is further superimposed on the velocity fluctuation of the gear A. Rotation irregularities occur when the two gears mesh with each other. The amplitude of the rotation irregularities occurring over time is larger than the amplitude in an early stage, as illustrated in FIG. 6. This increase in amplitude, i.e., an increase in velocity fluctuation, causes an adverse effect such as banding.

Meanwhile, there is an image forming apparatus having a speed reduction device in which an integer ratio is intentionally used. This speed reduction device drives a photosensitive drum that is an image carrier, or an intermediate transfer belt that is an intermediate transfer body. For example, as discussed in Japanese Patent Application Laid-Open No. 1988-113477, it is known to use an integer ratio as a speed reduction ratio on purpose in a speed reduction device that drives an intermediate transfer belt. This method is used to improve out of color registration in order to cancel a velocity fluctuation of a belt surface by a distance between photosensitive drums.

As described above, when the ratio between the numbers of teeth of gears is an integer ratio, imprinting occurs which causes uneven wear on a gear. Therefore, when an integer ratio is intentionally used, a resin material such as polyoxymethylene (POM) with high slidability is widely used.

Meanwhile, recent speed enhancement of image forming apparatuses has enabled use of a medium having a large grammage. At the time when the medium having a large grammage enters a secondary transfer part, a load on a speed reduction device driving a photosensitive drum or an intermediate transfer belt becomes greater than the load in the normal time. A load fluctuation when such a medium enters transfer part, may cause elastic deformation of a gear, leading to a velocity fluctuation of the photosensitive drum or the intermediate transfer belt, thereby creating a shock image. Therefore, gears of the speed reduction device have been expected to be rigid.

However, when the speed reduction device is configured of only metal gears with high rigidity to avoid the shock image, gear-to-gear contact noise becomes large, which makes the image forming apparatus less comfortable for a user. Therefore, a combination of a metal gear and a resin gear is used. However, if an integer ratio is used for the numbers of teeth of gears as discussed in Japanese Patent Application Laid-Open No. 1988-113477, and a combination of materials which are greatly varying in longitudinal elasticity is adopted to form a combination like a metal gear and a resin gear, an imprint on the resin gear having a smaller longitudinal elasticity becomes conspicuous. Therefore, an adverse effect such as banding of the image cannot be avoided.

SUMMARY OF THE INVENTION

The present invention is directed to an image forming apparatus capable of suppressing banding, while suppressing out of color registration.

According to an aspect of the present invention, an image forming apparatus includes, an image carrier configured be driven to rotate, a drive source configured to drive the image carrier, a first gear configured to transmit power of the drive source, and a second gear configured to transmit the power, by meshing with the first gear. A ratio between teeth of the first gear and teeth of the second gear is an integer, and the second gear has a diameter larger than a diameter of the first gear, and the teeth of the first gear are configured of a resin material, while the teeth of the second gear are configured of a metallic material.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings.

Exemplary embodiments to be described below are provided to describe the present invention exemplarily. Unless otherwise specified, the scope of the present invention is not limited to dimensions, materials, shapes, relative configurations, and the like of components to be described.

Figure 7:
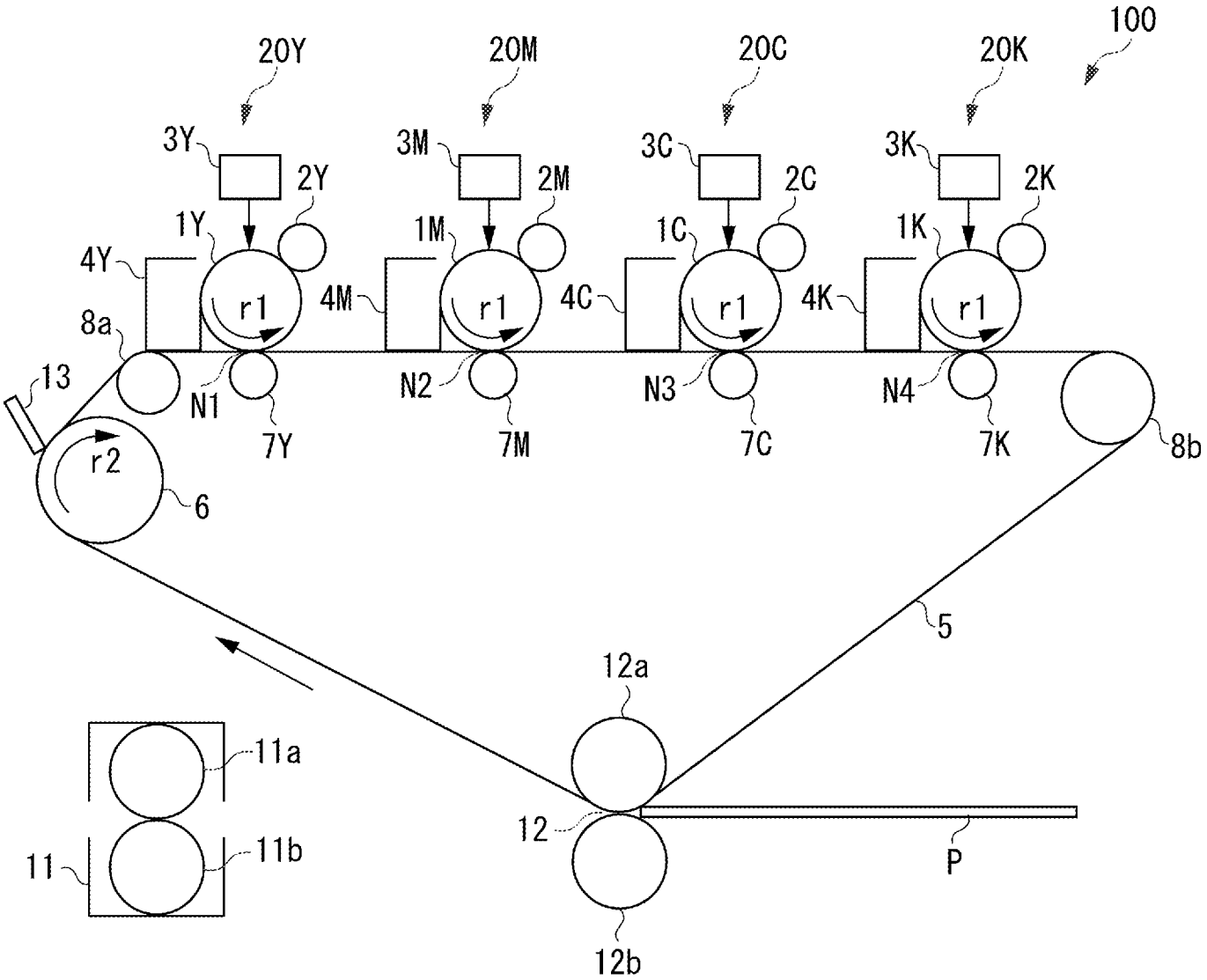
FIG. 7 is a schematic structural cross-sectional diagram of an image forming apparatus according to an exemplary embodiment of the present invention.

FIG. 7 is a schematic structural cross-sectional diagram illustrating an image forming apparatus 100 according to an exemplary embodiment of the present invention. In the present exemplary embodiment, the image forming apparatus 100 is an electrophotographic full color image forming apparatus.

The image forming apparatus 100 includes image forming units 20 (20Y, 20M, 20C, and 20K) that are four image forming units for forming yellow, magenta, cyan, and black images. In the image forming units 20Y, 20M, 20C, and 20K, photosensitive drums 1Y, 1M, 1C, and 1K that are drum-shaped electrophotographic photosensitive members each serving as a first image carrier are installed, respectively. Around the photosensitive drums 1Y, 1M, 1C, and 1K, charging rollers 2Y, 2M, 2C, and 2K, as well as development devices 4Y, 4M, 4C, and 4K are disposed, respectively. Further, transfer rollers 7Y, 7M, 7C, and 7K as well as drum cleaning devices (not illustrated) are installed around the photosensitive drums 1Y, 1M, 1C, and 1K, respectively. Above the charging rollers 2Y, 2M, 2C, and 2K, and the development devices 4Y, 4M, 4C, and 4K, exposure devices 3Y, 3M, 3C, and 3K are installed, respectively.

The four image forming units 20Y, 20M, 20C, and 20K are arranged at regular intervals, substantially in line with an intermediate transfer belt 5. The intermediate transfer belt 5 is shaped as an endless belt, and serves as second image carrier.

The photosensitive drums 1Y, 1M, 1C, and 1K are each driven by a driving device (not illustrated), to rotate at a predetermined circumferential speed in an arrow r1 direction.

The charging rollers 2Y, 2M, 2C, and 2K come in contact with the photosensitive drums 1Y, 1M, 1C, and 1K, respectively, with a predetermined pressure contact force. The charging rollers 2Y, 2M, 2C, and 2K thereby charge surfaces of the photosensitive drums 1Y, 1M, 1C, and 1K uniformly to a predetermined electric potential, by using a charging bias applied from a charging bias power source (not illustrated).

The surface of each of the photosensitive drums 1Y, 1M, 1C, and 1K is then exposed to light modulated according to a time-series electric digital pixel signal of image information that is input by a host computer, an image reading apparatus, or the like (not illustrated). As a result, an electrostatic latent image corresponding to the image information is formed on the charged surface of each of the photosensitive drums 1Y, 1M, 1C, and 1K.

The development devices 4Y, 4M, 4C, and 4K develop toner images (reversal development), by applying toner to the electrostatic latent images on the photosensitive drums 1Y, 1M, 1C, and 1K, respectively, by using a development bias applied from a development bias power supply (not illustrated). The development devices 4Y, 4M, 4C, and 4K contain yellow toner, cyan toner, magenta toner, and black toner, respectively. The toner image of a color corresponding to the image information is developed with the toner on each of the photosensitive drums 1Y, 1M, 1C, and 1K.

In the image forming apparatus 100, primary transfer rollers 7Y, 7M, 7C, and 7K, which are transfer members, are disposed at transfer parts N1, N2, N3, and N4. The transfer parts N1, N2, N3, and N4 are opposite the photosensitive drums 1Y, 1M, 1C, and 1K, respectively, with the intermediate transfer belt 5 interposed therebetween.

The primary transfer rollers 7Y, 7M, 7C, and 7K each include an electrode configured to uniformly apply a voltage along a longitudinal direction of the roller. The primary transfer rollers 7Y, 7M, 7C, and 7K abut on the photosensitive drums 1Y, 1M, 1C, and 1K, respectively, with the intermediate transfer belt 5 interposed therebetween.

The intermediate transfer belt 5 is stretched by a driving roller 6, driven rollers 8*a* and 8*b*, and a secondary transfer opposite roller 12*a*. The intermediate transfer belt 5 is rotated in an arrow r2 direction, by rotational driving of the driving roller 6. Rotational driving of each of the photosensitive drums 1Y, 1M, 1C, and 1K as well as the driving roller 6 is controlled by a not-illustrated control apparatus (central processing unit (CPU)).

Next, image forming operation by the image forming apparatus 100 of the present exemplary embodiment will be described.

When the host computer or the image reading apparatus (not illustrated) issues an image-forming-operation start signal, the image forming operation begins. The photosensitive drums 1Y, 1M, 1C, and 1K of the image forming units 20Y, 20M, 20C, and 20K, respectively, are driven to rotate at a predetermined process speed. The surfaces of the photosensitive drums 1Y, 1M, 1C, and 1K are uniformly charged by the charging rollers 2Y, 2M, 2C, and 2K, respectively. Each of the photosensitive drums 1Y, 1M, 1C, and 1K is driven by a motor (not illustrated) rotating at a predetermined speed, via a gear (not illustrated). This driving is controlled by the not-illustrated control apparatus (CPU). The exposure devices 3Y, 3M, 3C, and 3K each convert a color-separation image signal input by the host computer (not illustrated), into an optical signal. Using light of the converted optical signal, the exposure devices 3Y, 3M, 3C, and 3K scan and expose the charged photosensitive drums 1Y, 1M, 1C, and 1K, respectively, thereby forming the electrostatic latent images.

Subsequently, first, the development device 4Y applies the yellow toner to the electrostatic latent image formed on the photosensitive drum 1Y, so that the electrostatic latent image becomes visible as a yellow toner image. The development bias of the same polarity as a charging polarity of the photosensitive drum 1Y has been applied to the development device 4Y.

Next, at the transfer part N1 of the image forming unit 20Y, the yellow toner image is transferred onto the intermediate transfer belt 5 by the primary transfer roller 7Y to which a transfer bias (of a polarity opposite to the polarity of the toner) is applied. At this time, the primary transfer roller 7Y is pressed against the photosensitive drum 1Y with a predetermined pressure, with the intermediate transfer belt 5 interposed therebetween.

The intermediate transfer belt 5 with the transferred yellow toner image is moved by the driving roller 6 toward the image forming unit 20M. Subsequently, at the transfer part N2 of the image forming unit 20M, a magenta toner image formed likewise on the photosensitive drum 1M is transferred to be superimposed on the yellow toner image on the intermediate transfer belt 5. The magenta toner image is transferred by the primary transfer roller 7M to which a transfer bias (of a polarity opposite to the polarity of the toner) is applied.

Similarly, a cyan toner image and a black toner image, which are formed likewise on the photosensitive drums 1C and 1K of the image forming units 20C and 20K are sequentially superimposed on the intermediate transfer belt 5 at the transfer parts N3 and N4, by the primary transfer rollers 7C and 7K, respectively. A transfer bias (of a polarity opposite to the polarity of the toner) has been applied to each of the primary transfer rollers 7C and 7K. Thus, the toner images of full color are formed on the intermediate transfer belt 5.

The toner images of full color formed on the intermediate transfer belt 5 are collectively transferred onto a transfer material P, at a secondary transfer part 12. The transfer material P is then conveyed to a fixing device 11. The toner images of full color are heated and pressurized at a fixing nip part between a fixing roller 11*a* and a pressure roller 11*b* of the fixing device 11, to be thermally fixed onto the surface of the transfer material P. The transfer material P is then discharged to the outside, which completes a series of processes of the image forming operation.

It is to be noted that, the residual toner remaining on the photosensitive drums 1Y, 1M, 1C, and 1K after each transfer is removed and collected by the drum cleaning device (not illustrated). Further, the residual toner remaining on the surface of the intermediate transfer belt 5 after the transfer is removed by a cleaning blade 13, and collected.

Next, a driving configuration for moving the intermediate transfer belt 5 in the present exemplary embodiment will be described in detail.

Figure 1:
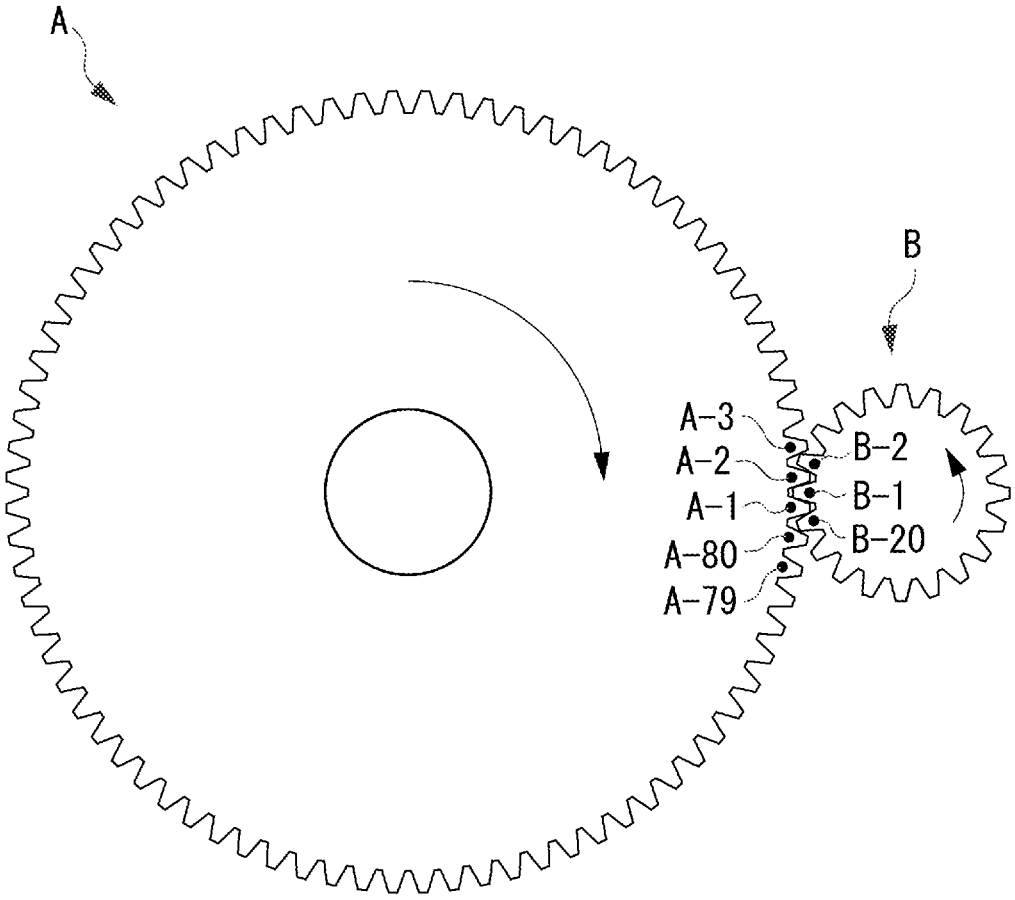
FIG. 1 PRIOR ART
FIG. 1 is a diagram illustrating meshing gears in a speed reduction device.
Figure 2:
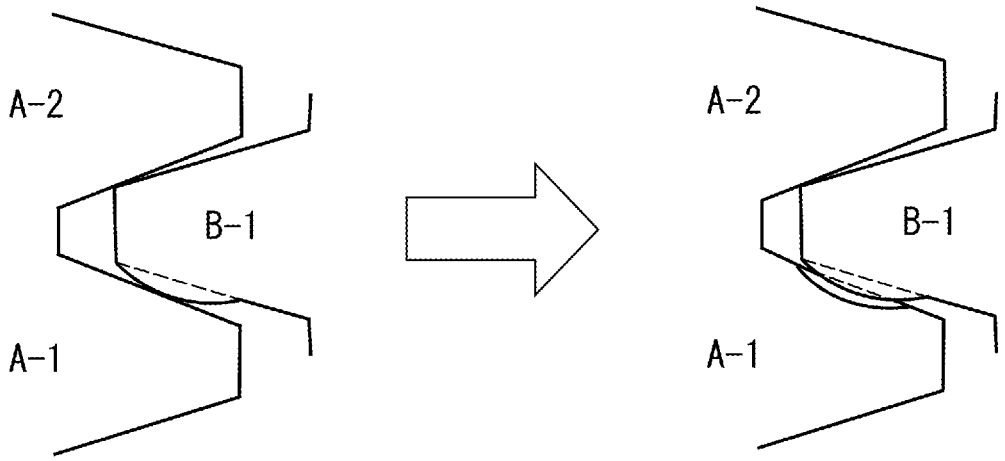
FIG. 2 PRIOR ART
FIG. 2 is a diagram illustrating an example of imprinting of a gear.
Figure 3:
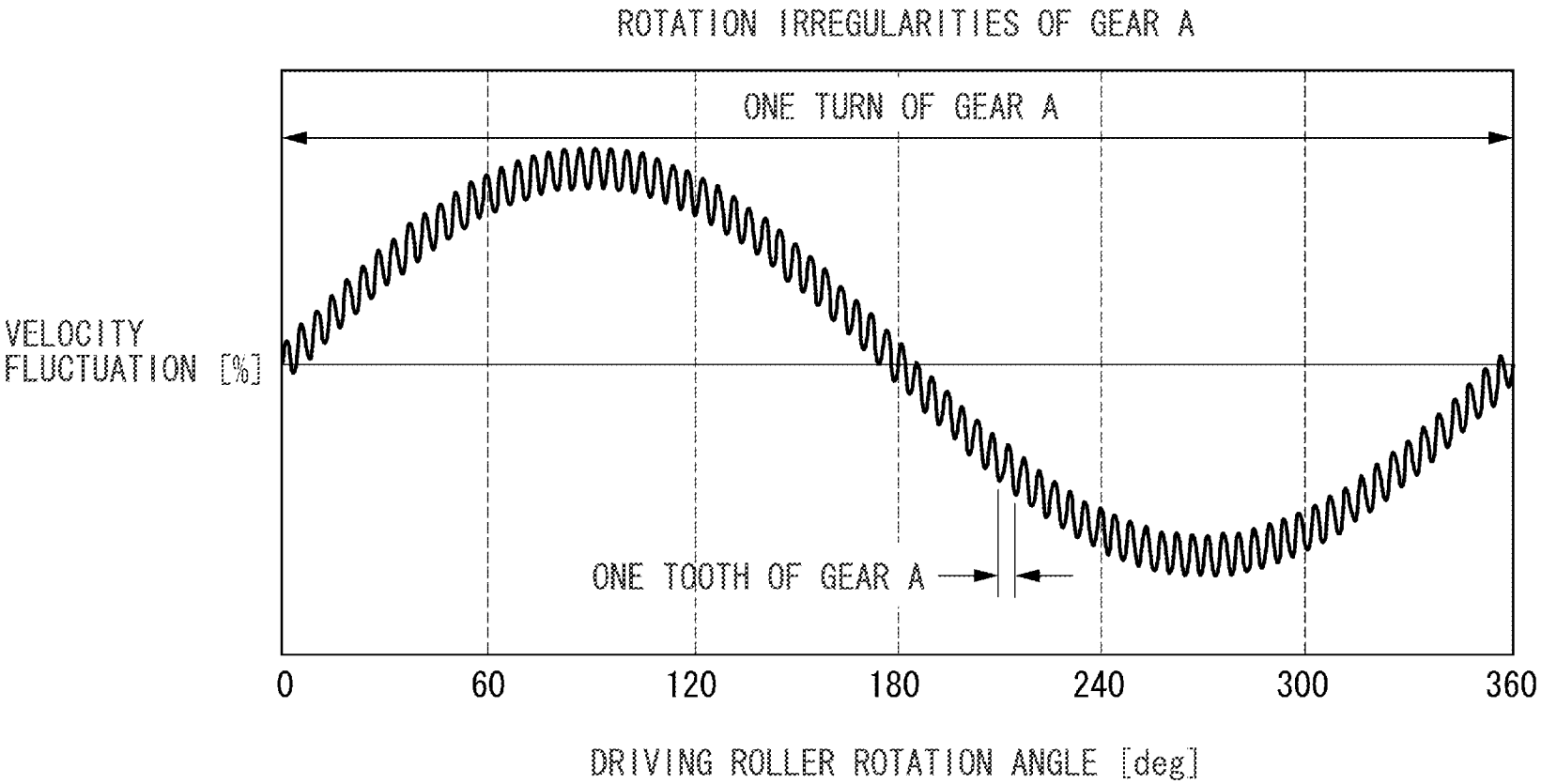
FIG. 3 PRIOR ART
FIG. 3 is a diagram illustrating a velocity fluctuation of a gear A.
Figure 4:
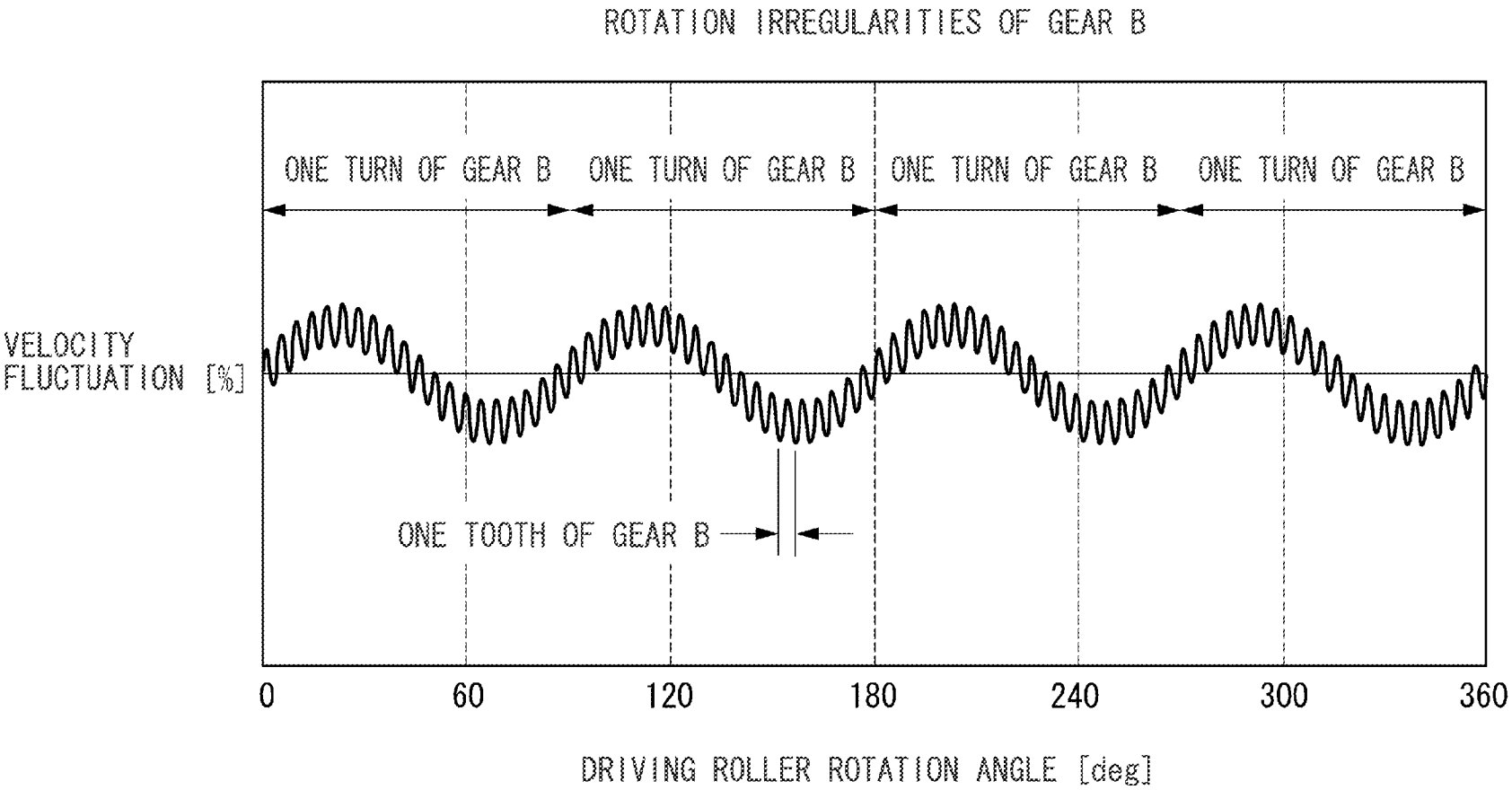
FIG. 4 PRIOR ART
FIG. 4 is a diagram illustrating a velocity fluctuation of a gear B.
Figure 5:
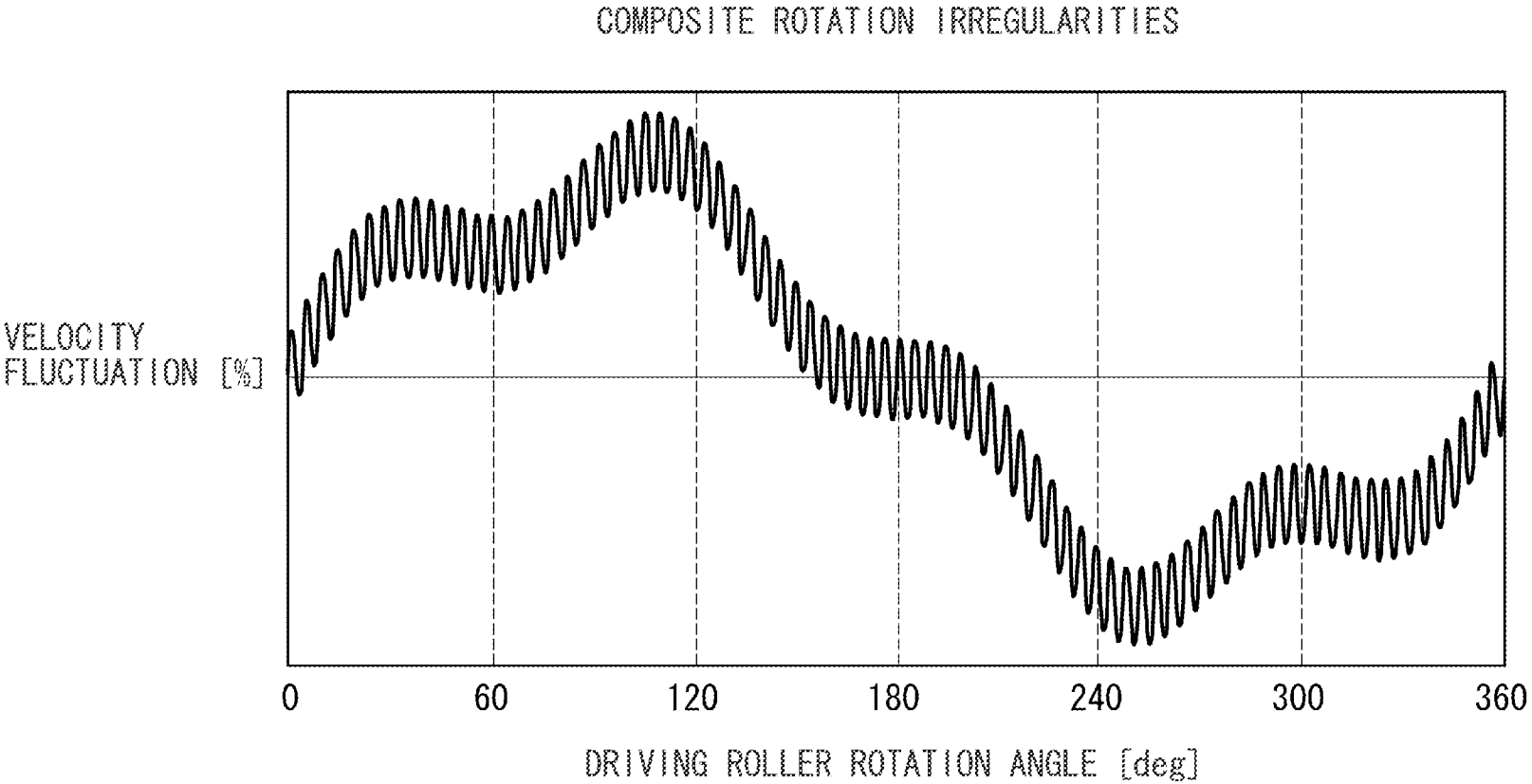
FIG. 5 PRIOR ART
FIG. 5 is a diagram illustrating a composite velocity fluctuation of the gear A and the gear B.
Figure 6:
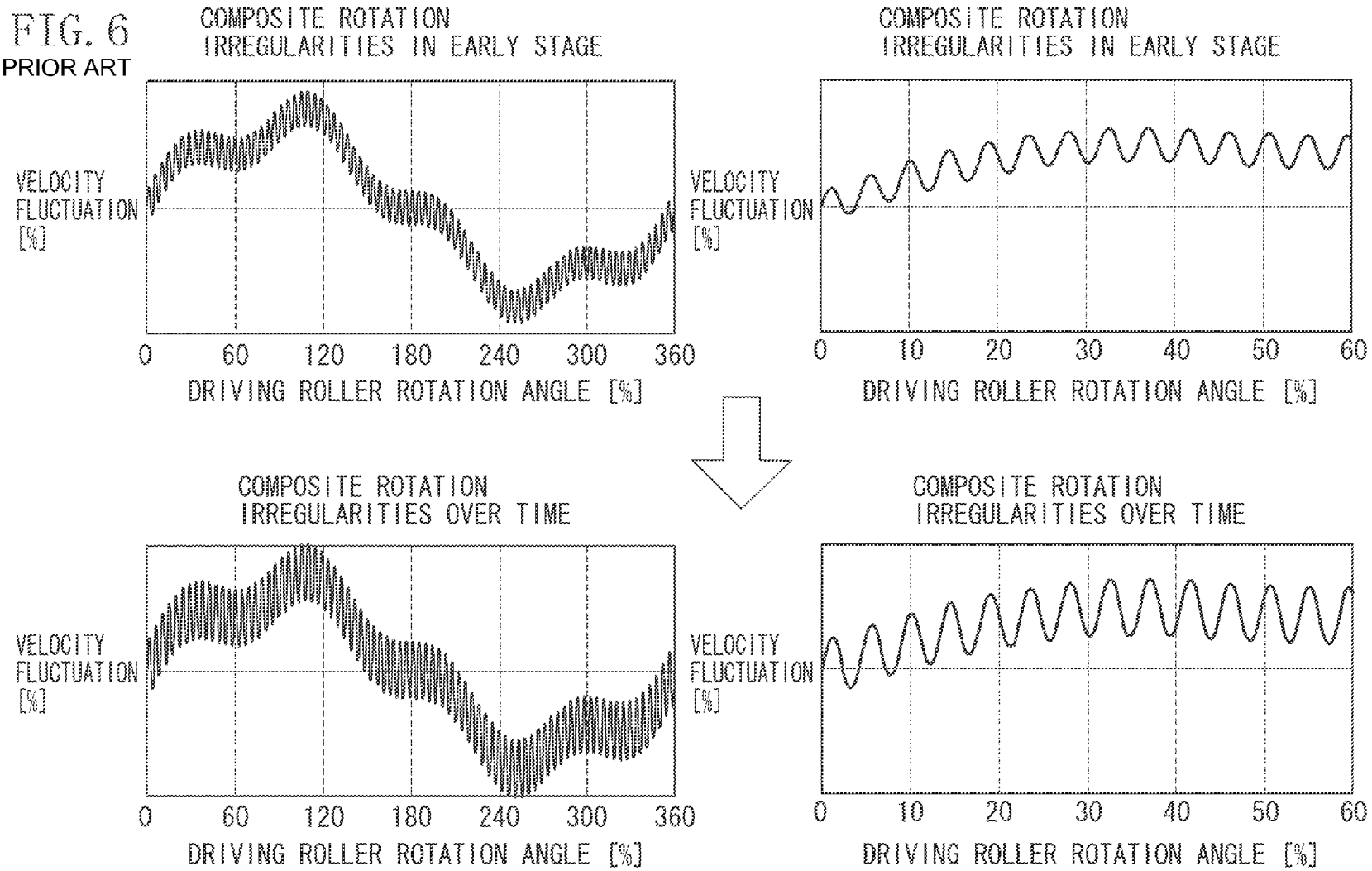
FIG. 6 PRIOR ART
FIG. 6 is a diagram illustrating a change occurring over time in the composite velocity fluctuation of the gear A and the gear B in which imprinting has occurred.
Figure 8:
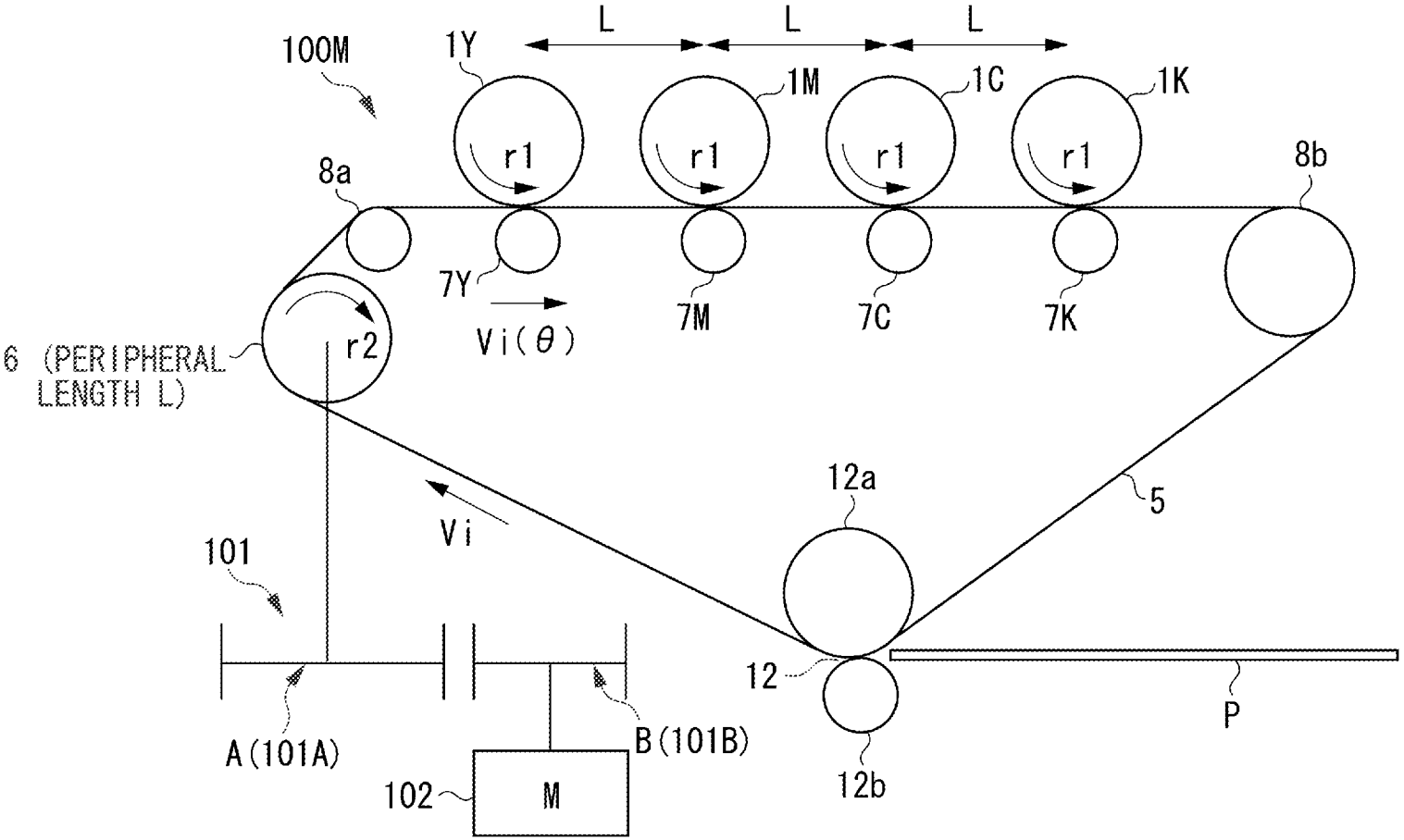
FIG. 8 is a schematic structural cross-sectional diagram of an intermediate transfer unit of the image forming apparatus according to the exemplary embodiment of the present invention.
Figure 9:
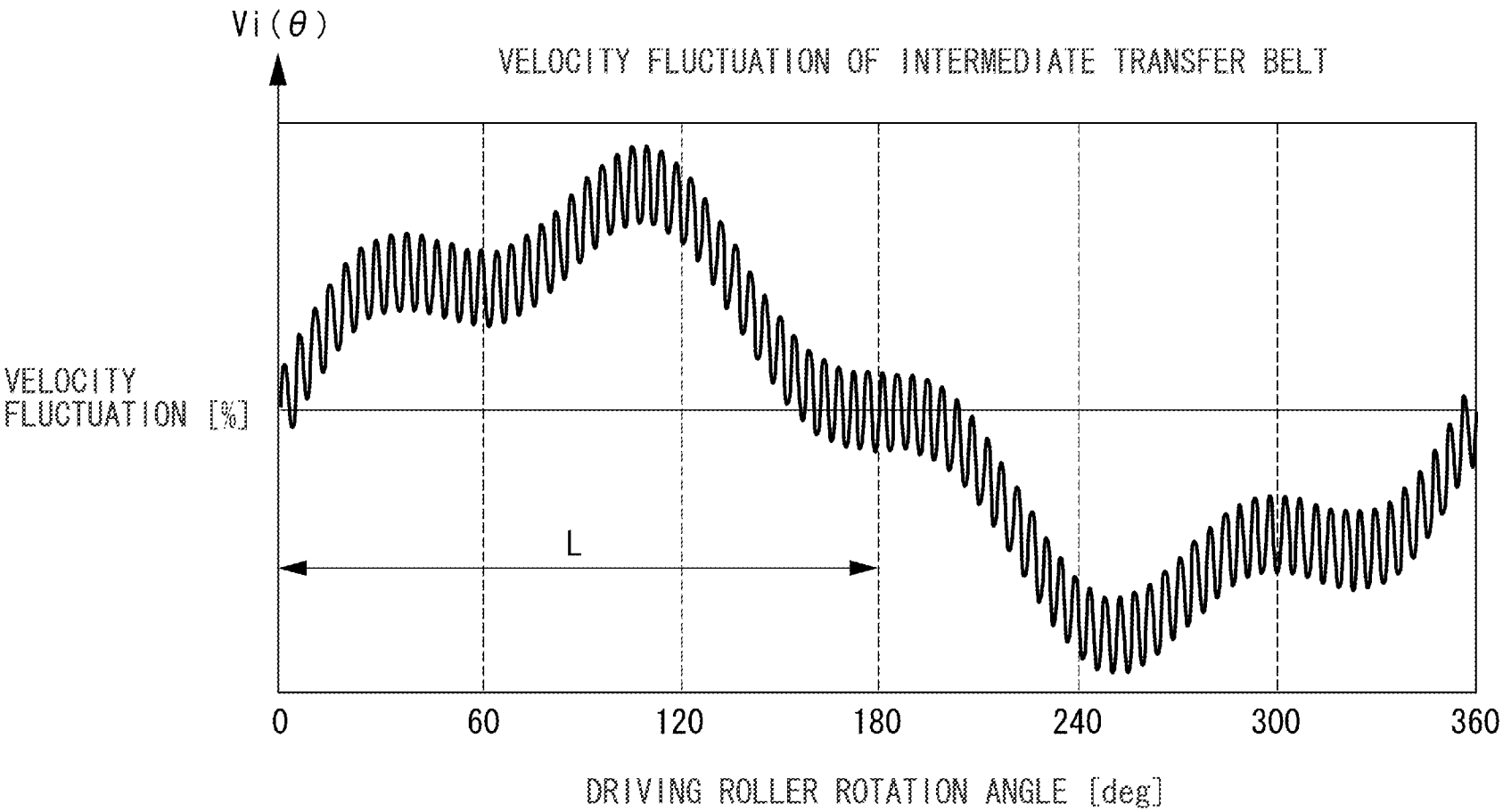
FIG. 9 is a diagram illustrating a velocity fluctuation of the intermediate transfer belt of the image forming apparatus according to the exemplary embodiment of the present invention.

FIG. 8 illustrates an intermediate transfer unit 100M. As illustrated in FIG. 8, the intermediate transfer unit 100M includes the photosensitive drums 1 (1Y, 1M, 1C, and 1K) of the image forming units of the respective colors, the intermediate transfer belt 5, and the primary transfer rollers 7 (7Y, 7M, 7C, and 7K), of the configuration of the above-described image forming apparatus 100. The intermediate transfer belt 5 is stretched by the driving roller 6, the driven rollers 8*a* and 8*b*, as well as the secondary transfer opposite roller 12*a*. As described above, the intermediate transfer belt 5 is moved by the rotational driving of the driving roller 6. The driving roller 6 is driven to rotate, by receiving power of a motor 102 that is a drive source, through a speed reduction device 101. Usually, a speed reduction device includes two or more gears. The driving roller 6 is driven to rotate, by receiving the power of the motor 102 through a gear B (101B) and a gear A (101A) that are a first gear and a second gear, respectively, of the speed reduction device 101 of the present exemplary embodiment. Here, the gear A (101A) and the gear B (101B) include 80 teeth and 20 teeth, respectively, and are included in the speed reduction device 101 having a speed reduction ratio of 4:1. FIG. 3 illustrates a velocity fluctuation of the gear A (101A), and FIG. 4 illustrates a velocity fluctuation of the gear B (101B). In the present exemplary embodiment, since the speed reduction ratio is 4:1, the gear B (101B) makes four turns for a single turn of the gear A (101A). As illustrated in FIG. 9, a velocity fluctuation on the surface of the intermediate transfer belt 5 is a composite wave of the waves illustrated in FIGS. 3 and 4. The intermediate transfer belt 5 is moved by the driving roller 6 driven to rotate through the gear A (101A) and the gear B (101B). In the present exemplary embodiment, a peripheral length L of the driving roller 6 is equal to a photosensitive drum pitch that is a distance between the photosensitive drums 1 including the uppermost-stream photosensitive drum 1Y to the lowermost-stream photosensitive drum 1K in an image forming direction. Further, the peripheral length L of the driving roller 6 is equivalent to a half cycle of a sine wave that is the velocity fluctuation of the gear A (101A). In other words, the driving roller 6 makes one turn, while the gear A (101A) makes a half turn. That is to say, a single turn of the driving roller 6 requires the gear A (101A) to make a half turn, or to rotate to an extent corresponding to an integer multiple of the half turn.

Figure 10:
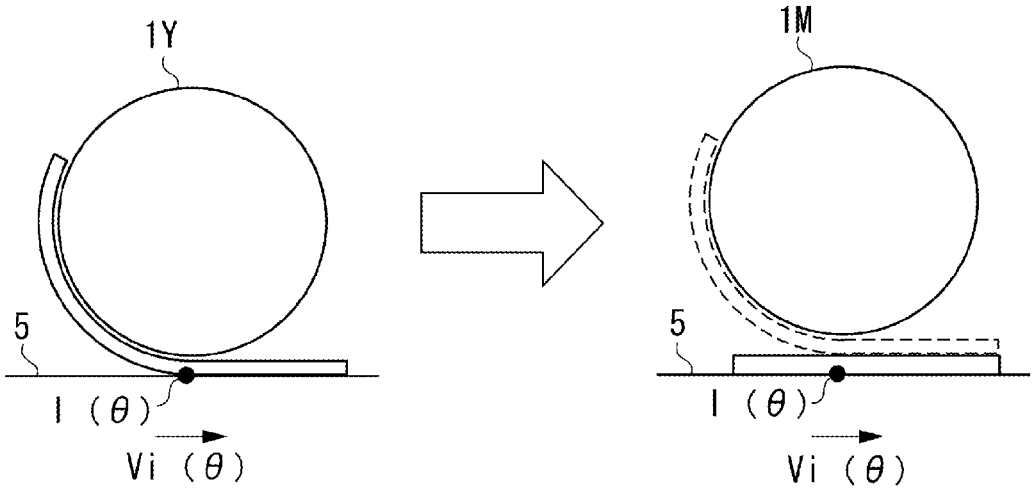
FIG. 10 is a diagram illustrating behavior of a transfer material at a primary transfer part of the image forming apparatus according to the exemplary embodiment of the present invention.

Here, as illustrated in the FIG. 9, a composite velocity fluctuation, which is a velocity fluctuation of the surface of the intermediate transfer belt, becomes 0% for every peripheral length L of the driving roller 6. In other words, as illustrated in FIG. 10, if a surface velocity of a surface I(θ) of the intermediate transfer belt 5 when the surface I(θ) passes through the photosensitive drum 1Y is assumed to be Vi(θ), a velocity of the surface I(θ) in passing through the photosensitive drum 1M is also Vi(θ). Similarly, a surface velocity of the surface I(θ) in passing through each of the photosensitive drums 1C and 1K is also Vi(θ). In other words, focusing on the surface I(θ), which is a certain surface of the intermediate transfer belt 5, the surface velocities of the intermediate transfer belt when this surface passes through the four photosensitive drums arranged in a line are the same. Therefore, velocity fluctuations due to rotation irregularities are cancelled by the peripheral length L, i.e., cancelled for each distance L that is the pitch of the photosensitive drums 1. The rotation irregularities are caused by an eccentric component of the gear A, the gear B, and the driving roller 6. This can suppress occurrence of out of color registration, thereby achieving a satisfactory image forming apparatus suppressing out of color registration.

Here, the gear A (101A) and the gear B (101B) meshing with each other in the speed reduction device 101 of the present exemplary embodiment will be described more in detail.

In the present exemplary embodiment, the gear A (101A) that is a larger diameter gear having 80 teeth is a metal gear (Stainless Used Steel (SUS), a modulus of longitudinal elasticity: 200 GPa). On the other hand, the gear B (101B)

that is a smaller diameter gear having 20 teeth is a resin gear (POM, a modulus of longitudinal elasticity: 4 GPa).

The gear B having a smaller modulus of longitudinal elasticity easily wears out because of a difference in material. In this combination, a plurality of teeth of the gear A (101A) comes in contact with one tooth of the gear B (101B) that easily wears out, as illustrated in Table 1.

TABLE 1

| | | | | | | | | | | | | | | | | | | | | |
|---|---|---|---|---|---|---|---|---|---|---|---|---|---|---|---|---|---|---|---|---|
| B | 1 | 2 | 3 | 4 | 5 | 6 | 7 | 8 | 9 | 10 | 11 | 12 | 13 | 14 | 15 | 16 | 17 | 18 | 19 | 20 |
| A | 1 | 2 | 3 | 4 | 5 | 6 | 7 | 8 | 9 | 10 | 11 | 12 | 13 | 14 | 15 | 16 | 17 | 18 | 19 | 20 |
| | 21 | 22 | 23 | 24 | 25 | 26 | 27 | 28 | 29 | 30 | 31 | 32 | 33 | 34 | 35 | 36 | 37 | 38 | 39 | 40 |
| | 41 | 42 | 43 | 44 | 45 | 46 | 47 | 48 | 49 | 50 | 51 | 52 | 53 | 54 | 55 | 56 | 57 | 58 | 59 | 60 |
| | 61 | 62 | 63 | 64 | 65 | 66 | 67 | 68 | 69 | 70 | 71 | 72 | 73 | 74 | 75 | 76 | 77 | 78 | 79 | 80 |

For example, teeth A-1, 21, 41, and 61 come in contact with a tooth B-1. When the plurality of teeth thus comes in contact with one tooth, a unique tooth shape is not imprinted. Therefore, imprinting becomes dull. One reason for this is as follows. When a plurality of teeth comes in contact with one tooth, a unique imprinted shape by a certain tooth is distorted (disturbed) by a unique shape of other teeth, which results in dull imprinting. However, in a case where contact is repeated by one surface of a certain tooth, an imprint retains a unique shape.

Here, assume a larger diameter gear A (101A) is a resin gear, and a smaller diameter gear B (101B) is a metal gear, which is contrary to the present exemplary embodiment. In this case, as illustrated in Table 2, a certain tooth of the gear B (101B) regularly comes in contact with a certain tooth of the gear A (101A) that easily wears out.

TABLE 2

| | | | | | | | | | | | | | | | | | | | | | |
|---|---|---|---|---|---|---|---|---|---|---|---|---|---|---|---|---|---|---|---|---|---|
| A | 1 | 2 | 3 | ~ | 9 | 10 | 11 | ~ | 20 | 21 | ~ | 30 | ~ | 40 | ~ | 50 | ~ | 60 | ~ | 70 | ~ | 80 |
| B | 1 | 2 | 3 | ~ | 9 | 10 | 11 | ~ | 20 | 1 | ~ | 10 | ~ | 20 | ~ | 10 | ~ | 20 | ~ | 10 | ~ | 20 |
| | 1 | 2 | 3 | ~ | 9 | 10 | 11 | ~ | 20 | 1 | ~ | 10 | ~ | 20 | ~ | 10 | ~ | 20 | ~ | 10 | ~ | 20 |
| | 1 | 2 | 3 | ~ | 9 | 10 | 11 | ~ | 20 | 1 | ~ | 10 | ~ | 20 | ~ | 10 | ~ | 20 | ~ | 10 | ~ | 20 |
| | 1 | 2 | 3 | ~ | 9 | 10 | 11 | ~ | 20 | 1 | ~ | 10 | ~ | 20 | ~ | 10 | ~ | 20 | ~ | 10 | ~ | 20 |

For example, a tooth B-1 regularly comes in contact with a tooth A-1. Such regular contact by the same tooth intensifies imprinting.

In contrast, in the present exemplary embodiment, the larger diameter gear A (101A) is a metal gear and the smaller diameter gear B (101B) is a resin gear. Therefore, the present exemplary embodiment is advantageous in terms of imprinting. The composite velocity fluctuation of the gear A (101A) and the gear B (101B) of the speed reduction device 101 thus configured is as illustrated in FIG. 9. This composite velocity fluctuation is stable unlike a composite velocity fluctuation, which has such a configuration, that imprinting easily occurs. Using the speed reduction device having the gears configured as described above, the image forming apparatus 100 of the present exemplary embodiment can achieve both suppression of shock image and suppression of banding, and therefore can form a satisfactory image in which out of color registration is suppressed.

The present exemplary embodiment has been described with reference to the speed reduction device for driving the intermediate transfer belt. In the present exemplary embodiment, the large diameter gear is the gear having a large modulus of longitudinal elasticity. This is also effective for other device such as a speed reduction device for driving and rotating a photosensitive drum, when an integer multiple is used.

Further, in the present exemplary embodiment, each of the materials has been described as a material of the entire gear, but the material may be of only a part of the gear.

According to a typical embodiment of the present invention, an image forming apparatus capable is provided that can form a satisfactory image in which out of color registration is suppressed, while achieving both suppression of shock image and suppression of banding.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-098657, filed May 8, 2013, which is hereby incorporated by reference herein in its entirety.

What is claimed is:

1. An image forming apparatus comprising:

a plurality of first image bearing members;

a second bearing member, onto which an image formed on each of the first bearing members is transferred;

a driving roller configured to rotate the second bearing member;

a drive source;

a first gear which includes teeth which are configured of a resin material to transmit a driving force from the drive source;

a second gear which includes teeth which are configured of a metallic material to transmit the driving force from the first gear to the driving roller by meshing with the first gear, wherein the second gear is established so that a number of the teeth of the second gear is larger than a number of the teeth of the first gear, and is equal to the integral multiple of a number of the teeth of the first gear, wherein the first gear and the second gear transmit the power to the driving roller for driving the second bearing member, and wherein the first image bearing members are disposed at equal intervals L, and the interval L is an integer multiple of a peripheral length of the driving roller.

2. The image forming apparatus according to claim 1, wherein said first gear and said second gear are speed reduction mechanisms with respect to a drive source.

* * * * *